United States Patent [19]

Sheiman

[11] Patent Number: 4,782,947

[45] Date of Patent: Nov. 8, 1988

[54] ARRANGEMENT FOR SECURELY HOLDING GARMENT HANGERS WITHIN GARMENT BAGS

[75] Inventor: Samuel R. Sheiman, Brooklyn, N.Y.

[73] Assignee: Crest Lock Co. Inc., New York, N.Y.

[21] Appl. No.: 46,724

[22] Filed: May 7, 1987

[51] Int. Cl.[4] ..... A45C 5/12; B65D 85/18

[52] U.S. Cl. ..... 206/279; 206/289; 206/290; 190/13 R; 211/124

[58] Field of Search ..... 206/279, 286, 287, 287.1, 206/289, 290, 291, 278; 190/13 R; 211/94.5, 124, 94; 248/340; 223/88

[56] References Cited

U.S. PATENT DOCUMENTS

| | | | |
|---|---|---|---|
| 1,717,078 | 6/1929 | Wheary | 206/290 X |
| 2,215,695 | 9/1940 | Ginsberg | 206/279 |
| 2,285,745 | 6/1942 | Ritter, Jr. | 206/278 X |
| 2,596,412 | 5/1952 | Kish, Jr. et al. | 206/287.1 X |
| 2,681,128 | 6/1954 | Staffa | 206/290 X |
| 2,705,180 | 3/1955 | Enrich | 206/278 X |
| 2,862,586 | 12/1958 | Davis | 206/287.1 |
| 2,918,997 | 12/1959 | Kotkins | 206/291 |
| 3,035,673 | 5/1962 | Schenkler | 206/291 X |
| 3,141,535 | 7/1964 | Hamilton | 190/13 R |
| 3,335,826 | 8/1967 | Swirles | 206/287.1 |
| 3,419,154 | 12/1968 | Shapiro et al. | 211/124 X |
| 3,542,170 | 11/1970 | Bialo | 206/287.1 X |
| 3,566,456 | 3/1971 | London | 206/285 X |
| 4,252,220 | 2/1981 | London et al. | 206/287 |
| 4,340,145 | 7/1982 | Cameron | 211/124 |
| 4,363,388 | 12/1982 | London et al. | 206/285 X |
| 4,640,414 | 2/1987 | Mobley et al. | 206/279 X |

FOREIGN PATENT DOCUMENTS

| | | | |
|---|---|---|---|
| 176150 | 9/1953 | Austria | 211/124 |
| 51-0625 | 8/1939 | United Kingdom | 206/290 |

*Primary Examiner*—William Price
*Assistant Examiner*—Sue A. Weaver
*Attorney, Agent, or Firm*—Kirschstein, Kirschstein, Ottinger & Israel

[57] ABSTRACT

Garment hangers are suspendably and slidably supported on stationary support rails mounted to and below a top plate mounted to an interior top wall of a garment bag. The hangers are locked in position on the stationary rail by either pivoting a track extension from an initial aligned position with the rail to a blocking position transverse to the rail, or by clamping the hangers by a clamp which moves in a rectilinear direction toward and away from the rail.

17 Claims, 4 Drawing Sheets

FIG. 3
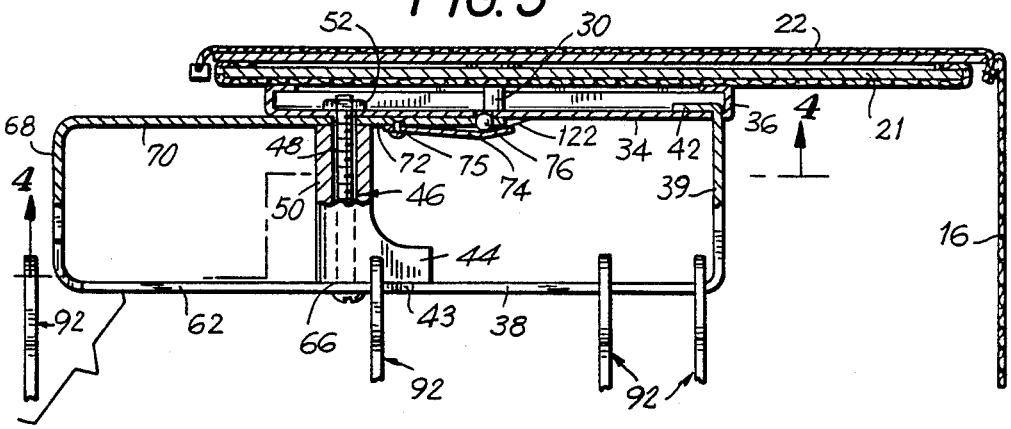
FIG. 4
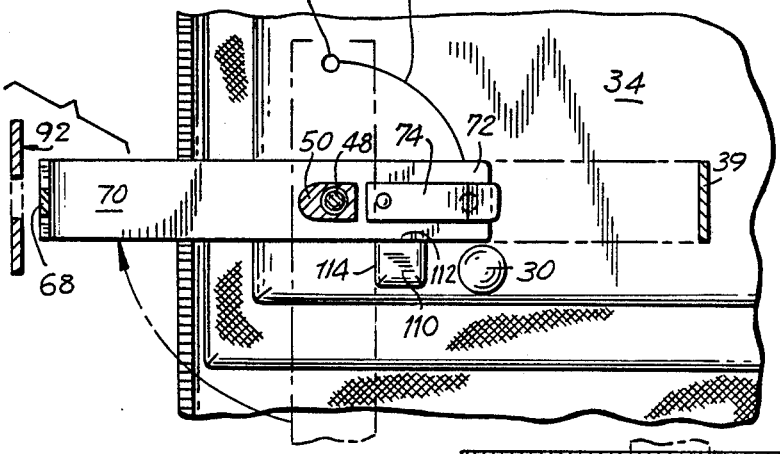
FIG. 5
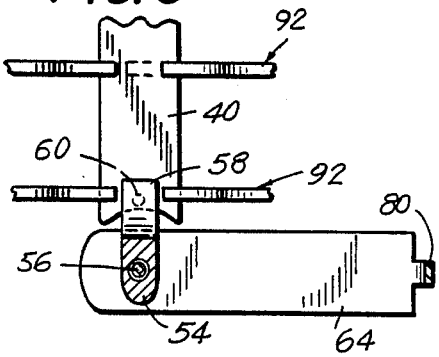
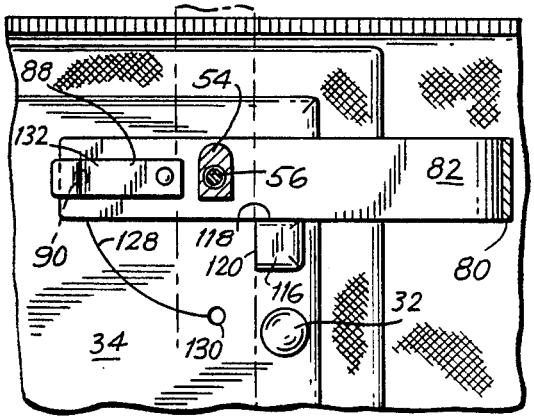
FIG. 6

FIG. 9
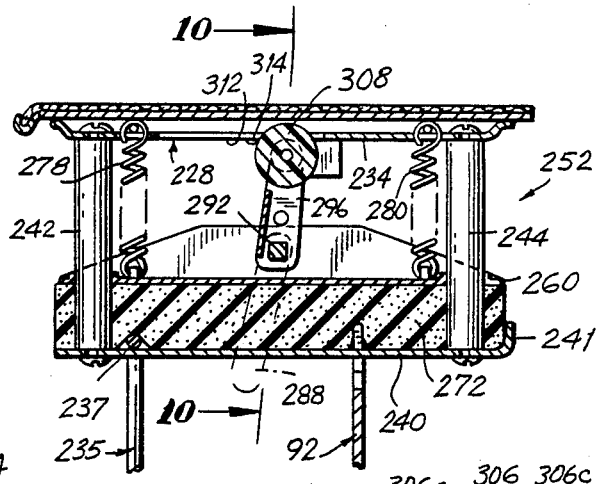
FIG. 10
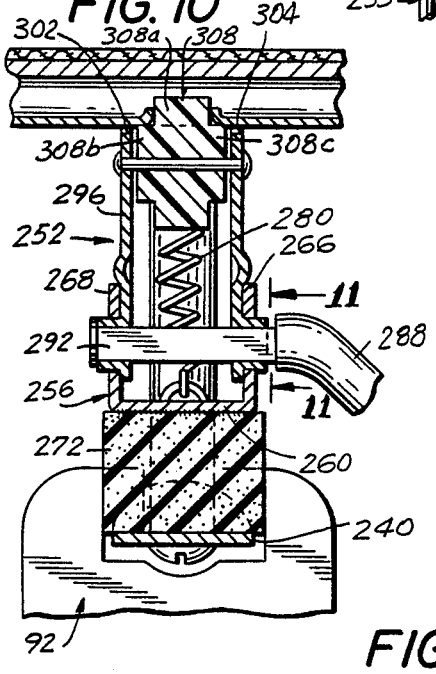
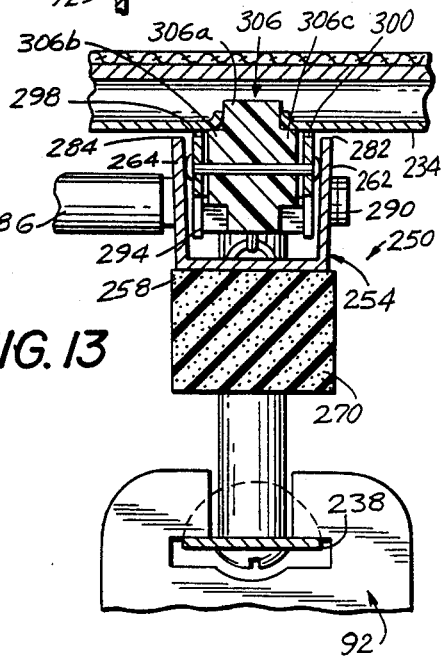
FIG. 13
FIG. 11
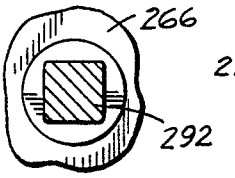
FIG. 12
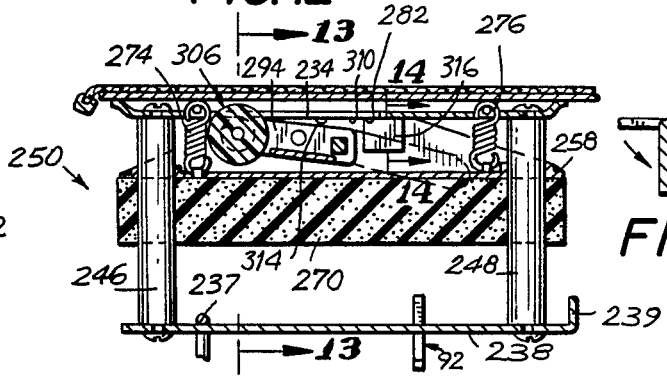
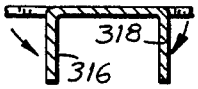
FIG. 14

ARRANGEMENT FOR SECURELY HOLDING GARMENT HANGERS WITHIN GARMENT BAGS

BACKGROUND OF THE INVENTION

1. Field of the Invention

This invention generally relates to arrangements for securely holding garment hangers within garment bags and, more particularly, to clamping and locking assemblies operative for preventing garment hangers and clothes hung therefrom from falling during handling of the bags in transit.

2. Description of Related Art

Various clamping and locking assemblies have heretofore been proposed for holding one or several garment hangers which support different items of clothing which are to be housed in their entirety within the confines of a garment bag. Such bags are conventionally used by travelers. See, for example, U.S. Pat. Nos. 3,566,456; 4,252,220 and 4,363,388.

Although generally effective for their intended purpose, experience has shown that the known garment holding assemblies suffer from the drawback that at least some of the hangers work themselves loose from their confinement, particularly during rough handling of the bag during transit. These loose hangers drop into the bag with concomitant wrinkling and crushing of the clothing.

Furthermore, after transit, the garment bag is typically unloaded in a hotel room or the like, and the hangers are individually hung on a closet pole or analogous support. However, the unloading of hangers has had problems associated therewith. In a conventional construction, all of the hangers are supported on a movable leg of a clamp. When the clamp is opened, by moving the movable leg downwardly in a vertical plane, several, or in some cases, all, of the hangers slide downwardly lengthwise along the movable leg, thereby permitting or more of the hangers to fall, with the aforementioned concomitant wrinkling and crushing of the clothing on the fallen hanger. To prevent this sliding problem, the movable clamp leg of such prior art constructions has been provided with roughened or notched surfaces, but, nevertheless, invariably some hangers fall.

Another conventional clamping assembly opens a movable leg of a clamp on a horizontal plane, in which case, all of the hangers are freed at once. Hence, to prevent falling, all of the hangers have to be grasped and held all at once in one hand and, thereupon, hung either individually, severally, or all together on the closet pole with the other hand, a feat which may be difficult for some travelers to perform without unduly wrinkling the clothes.

Some travelers prefer not to unload all the contents of the garment bag upon their arrival in the hotel room, but, instead, hang the entire bag from the closet pole or closet door, and unload only those hanger-supported garments as and when needed. The problem with such selective unloading is that the clothes, which are typically packed in close quarters for compact storage and handling, tend to crush one another when they remain in such compact relation for long periods of time.

SUMMARY OF THE INVENTION

1. Objects of the Invention

It is a general object of this invention to overcome the aforementioned drawbacks of conventional clamping and locking assemblies for securely holding garment hangers within garment bags.

It is another object of this invention to reliably prevent garment hangers from falling and clothes from wrinkling despite rough handling of a bag in transit.

A further object of this invention is to conveniently and rapidly load and unload garment hangers, one at a time, in and from the bag.

Still another object of this invention is to lockingly secure garment hangers of various types and constructions in the same garment bag.

Yet another object of this invention is to enable a traveler to spread apart hanger-supported garments and avoid crushing of adjacent garments in a bag whose contents are not to be unloaded all at once.

2. Features of the Invention

In keeping with these objects, and others which will become apparent hereinafter, one feature of this invention resides, briefly stated, in an arrangement for holding garment hangers within a travel garment bag having a interior top wall. The arrangement comprises a top plate stationarily mounted to the interior top wall of the bag. A stationary elongated support rail is stationarily mounted to and below the top plate. Garment hangers are suspendably and slidably supported from the stationary rail.

The arrangement further comprises means for locking the garment hangers on the stationary rail. The locking means prevents demounting of the hangers during handling of the bag in transit.

Hence, in accordance with this invention, no longer are garment hangers suspendably supported from movable clamp legs. This avoids the problem of falling hangers and the wrinkling of fallen clothes. This also avoids the drawback of having to grasp all of the hangers all at once in order to unload the bag.

In accordance with one preferred embodiment of this invention, the locking means includes a pivotable elongated track extension mounted to and below the top plate for pivoting movement relative to the stationary rail along a path between an extended and a locked position. The track extension is aligned with the stationary rail in the extended position, and forms a continuation of the rail along which garment hangers may also be suspendably and slidably supported. In other words, garment hangers can be spread apart to a greater extent than heretofore with the advantage that the clothes supported thereon are less likely to crush one another. The track extension is situated transverse to the stationary rail in the locked position, thereby preventing garment hangers from sliding off the stationary rail.

A stationary abutment, e.g., a tongue, offset from the top plate has side edges situated in the path of pivoting movement of the track extension. One side edge abuts the track extension in the extended position, while another side edge abuts the extension in the locked position. These side edges effectively prevent the extension from being moved past either the extended or locked positions.

The locking means further advantageously includes snap-action elements, e.g. a projection and a spring cooperating to snappingly secure the extension in both the extended and locked positions. The spring and the projection are mounted on the extension for joint pivoting movement therewith, the spring resiliently pressing the projection against the top plate. A pair of detents or dimples in the top plate are spaced angularly apart along the path of pivoting movement of the extension. Each detent receives the projection with snap action in a respective one of the extended and locked positions.

In accordance with another embodiment, the locking means includes a movable clamp mounted on and below the top plate for rectilinear movement away from and toward the stationary rail in a rectilinear direction generally perpendicular to the elongation of the rail along a path between a non-clamped and a clamped position. The clamp is raised above the rail in the non-clamped position. The clamp is lowered onto the rail and clampingly engages any garment hangers supported on the rail in the clamped position.

Advantageously, the movable clamp includes a substantial rigid backing member, and a resilient material block secured to the backing member and facing the rail. A pair of elongated guide posts extending along the rectilinear direction pass through guide holes formed through the backing member and the block for rectilinearly guiding the block.

The clamp further includes a manually turnable handle, and an elongated lever having a driven end pivotably mounted on the backing member for joint turning with the handle. The lever has an opposite drive end on which a roller is journaled. The roller is urged into rolling engagement with the top plate by a pair of elongated coil springs whose opposite ends are connected between the top plate and the backing member. The coil springs constantly urge the clamp to the non-clamped position.

The roller has a central wheel portion received in and rollable along an elongated slot formed in the top plate. The roller also has two side stub portions in rolling engagement with wall portions on the top plate which bound the slot.

Stationary abutments on the top plate are situated in the path of rectilinear movement of the clamp. These abutments stop the clamp in both the non clamped and clamped positions. The stationary abutments include a tongue opposite and depending downwardly from the top plate, and a ride-over bump. The tongue and bump are situated on opposite sides of a respective stub portion for locking the same therebetween and for fixing the clamp in the clamped position.

It is further advantageous if two support rails and two locking means are mounted on the top plate, preferably in side-by-side relation. The garment hangers that may be suspended from the support rail may be of many different types. For example, one type of hanger is of the so-called "track type" having in-turned flange portions overlying the support rail. Another type of garment hanger is of the so-called "wire type" and has a wire hook hooked over the support rail. The aforementioned resilient material block overlies the flange portions and wire hook and clampingly engages both the wire hook and flange portions against the support rail.

The novel features which are considered as characteristice of the invention are set forth in particular in the appended claims. The invention itself, however, both as to its construction and its method of operation, together with additional objects and advantages thereof, best will be understood from the following description of specific embodiments when read in connection with the accompanying drawings.

BRIEF DESCRIPTION OF THE DRAWINGS

FIG. 3 is a sectional view taken on line 3—3 of FIG. 2;

FIG. 4 is a sectional view taken on line 4—4 of FIG. 3;

FIG. 5 is a sectional view taken on line 5—5 of FIG. 2;

FIG. 6 is a sectional view taken on line 6—6 of FIG. 2;

FIG. 9 is a sectional view taken on line 9—9 of FIG. 8;

FIG. 10 is a sectional view taken on line 10—10 of FIG. 9;

FIG. 11 is a sectional view taken on line 11—11 of FIG. 10;

FIG. 12 is a sectional view taken on line 12—12 of FIG. 8;

FIG. 13 is a sectional view taken on line 13—13 of FIG. 12; and

FIG. 14 is an enlarged, sectional view taken on line 14—14 of FIG. 12.

DETAILED DESCRIPTION OF THE PREFERRED EMBODIMENTS

Figure 1:
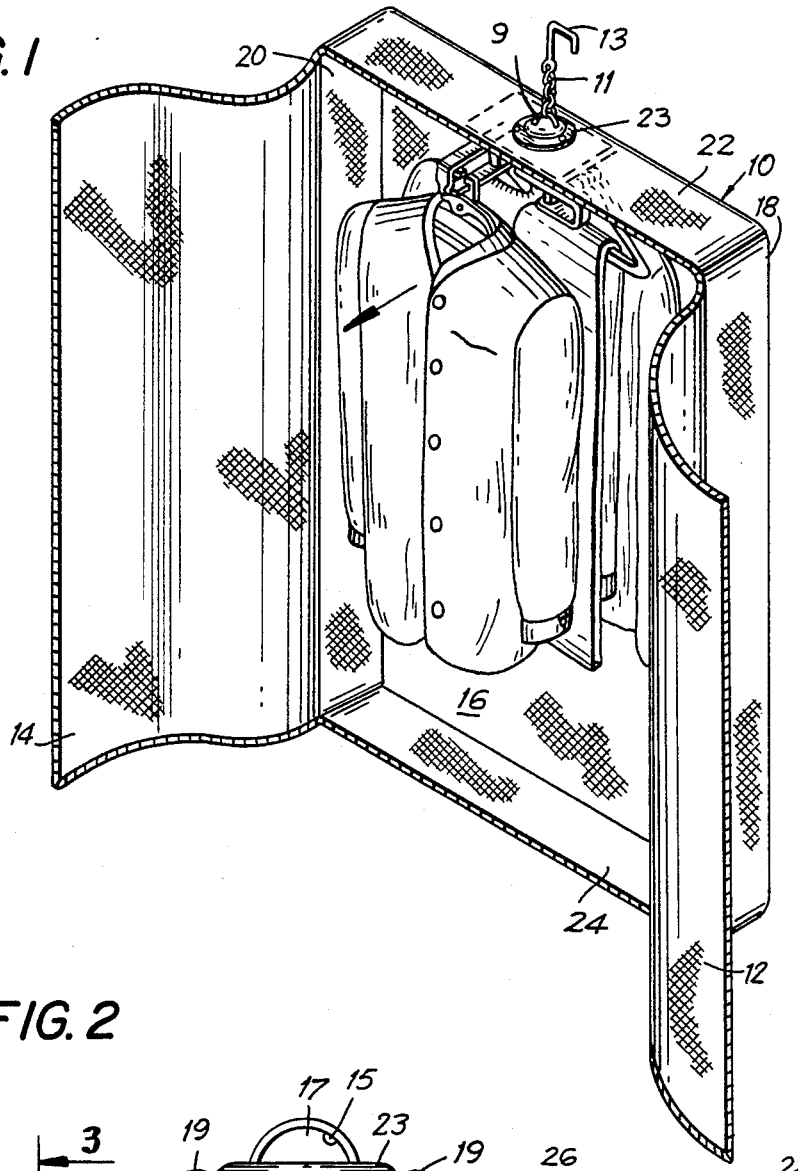
FIG. 1 is a front perspective view of one embodiment of a holding arrangement for holding garment hangers within a travel garment bag, shown opened for ease of illustration, in accordance with this invention.

Referring now to the drawings and, more particularly, to FIG. 1, reference numeral 10 generally identifies a travel garment bag of conventional construction. Bag 10 is fabricated of flexible material, preferably a suitable wear-resistant and water-resistant fabric, leather, vinyl, synthetic plastic, or the like. Bag 10 has one, and preferably two, front panels 12, 14, a rear panel 16, two side panels 18, 20, a top panel 22 and a bottom panel 24, all of the orientations of the panels being considered in the intended orientation of use, as shown in FIG. 1. The bag may be shaped into a generally parallelepiped configuration by inner frame members which extend at least partly along the top and side walls. A slide fastener or zipper may be provided between the front panels 12, 14 running between the top and bottom panels to permit separation of the front panels and ready access to the interior of the bag. Additional zippers may extend across upper and lower edges of the front panels to permit an even wider access.

Although not shown, in order not to obfuscate the invention a carrying handle or strap for transporting the bag is affixed centrally to the top panel 22, typically by being riveted to an internal frame member 21 and/or a liner underlying the top panel 22. A central escutcheon plate 23 is likewise riveted to the center of the top panel 22 and to the internal frame member 21 by means of rivets 19 extending through top panel 22. Plate 23 seats a movable spherically-shaped member 17 that is provided with recesses 15 into which a spring hook 9 is inserted. A detachable hook member 13 is connected to one end of a ball chain 11, the other end of which is connected to the spring hook 9. The hook 9 is detachably engaged with openings 15 in the member 17. The hook member 13 is used to suspend the garment bag 10 from a wall hook, closet door, closet pole or the like in the course of loading or unloading garments from the bag.

Further details of bag 10 are not necessary for an understanding of the present invention which, as noted above, strictly relates to arrangements for holding garment hangers within garment bags. It will be expressly understood that other types, styles and shapes of bags different from that illustrated in FIG. 1 could be utilized in the practice of this invention.

As shown more clearly in FIGS. 2–6, a holding arrangement 26 includes a top plate 28 stationarily mounted at a central interior region of top panel 22. Rivets 30,32 at opposite sides of the top plate 28 fixedly secure the plate 28 to the top panel 22 and extend through the internal frame member 21. Plate 28 has a generally planar outer major surface 34 which is spaced a short distance, e.g. on the order of ⅛", from the underside of frame member 21 due to the presence of border walls 36 extending around the perimeter of major surface 34 and extending generally perpendicularly to the latter.

A pair of stationary elongated support rails 38, 40 are stationarily mounted to and below the top plate 28 at opposite sides thereof in side-by-side relation. As best shown in FIG. 3, for representative support rail 38, its rear end region is bent to form a right-angled upright leg 39 whose upper support region is passed through a slot in plate 28 and is again bent at a right angle to form bent flange 42. A front end region of support rail 38 is riveted at rivet 43 to a rear section 44 of an upright standoff 46. A threaded fastener 48 passes with clearance though a front section 50 of standoff 46. The upper end of fastener 48 is situated in the space between outer surface 34 of plate 28 and the frame member 21, in which space a threaded nut 52 is threaded onto the upper end of fastener 48, thereby fixedly securing the rail 38 to the plate 28 and in mutual parallelism with major surface 34.

Figure 2:
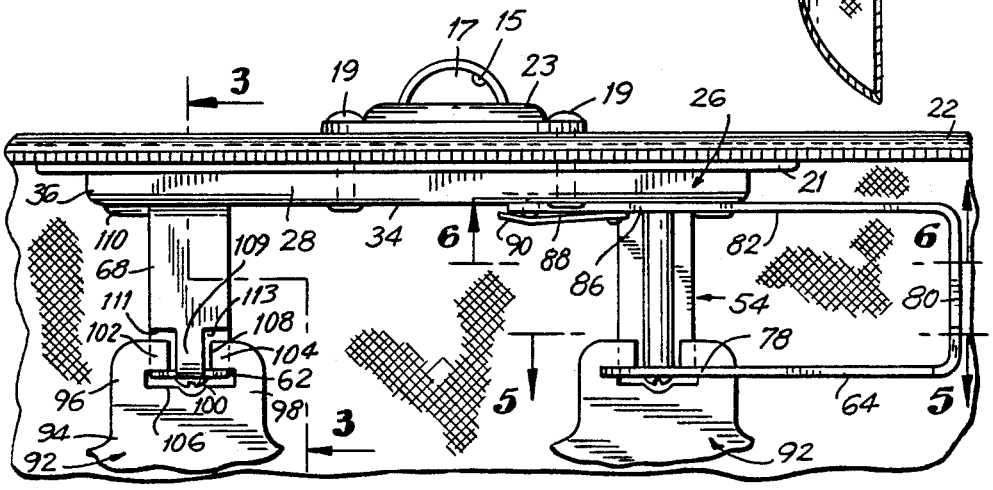
FIG. 2 is a broken-away, partly sectioned, enlarged, front view of the holding arrangement of FIG. 1 with one track extension shown in extended position, and with another track extension shown in locked position.
Figure 7:
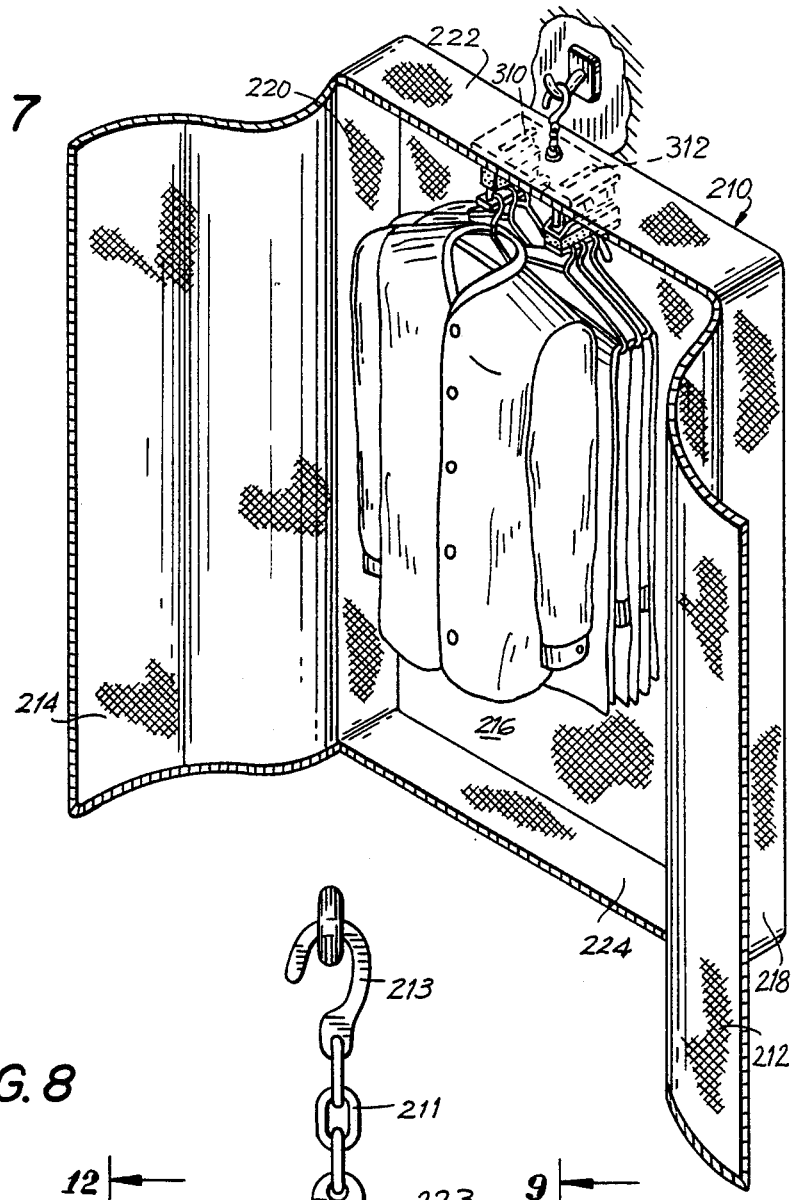
FIG. 7 is a front perspective view analogous to FIG. 1, but of another embodiment of the holding arrangement in accordance with this invention.

The identical structure exists for the other support rail 40 and will not be repeated for the sake of brevity. As best shown in FIGS. 2 and 5, an upright standoff 54 interconnects a front end region of support rail 40 to and below the top plate 28. A threaded fastener 56, identical to fastener 48, extends with clearance through the standoff 54. A rear end region 58 of the standoff 54 is riveted at rivets 60 to a front end region of the support rail 40. The support rails 38, 40 are made of a rigid material, e.g. metal, and lie in a common plane generally parallel to major surface 34 of plate 28. It is on either one or both rigid stationary support rails 38, 40 that garment hangers are suspendably and slidably supported, as described below.

A pair of pivotable elongated track extensions 62, 64 are mounted to and below the top plate 28 for independent pivoting movement relative to the support rails 38, 40, respectively, within the aforementioned common plane. As best shown in FIG. 3, track extension 62 has a rear end region 66 journaled around fastener 48 for pivoting movement around a vertical turning axis extending lengthwise of fastener 48. Track extension 62 is bent to form a right-angled upright leg 68 which is generally parallel to leg 39. Leg 68 is, in turn, bent in a plane parallel to extension 62 to form another leg 70. Leg 70 has a rear end region 72 which is likewise journaled around fastener 48 for pivoting movement about the aforementioned vertical turning axis. Biasing means, e.g. leaf spring 74, has one end 75 anchored to rear end region 72 for joint movement therewith. A ball 76 confined in a hole formed in, and projecting slightly through, the rear end region 72 is resiliently pressed upwardly by the spring 74 against the top plate 28. As described in greater detail below, the leaf spring and ball serve as snap-action means for snappingly securing the track extension 62 in either one of its end-limiting positions.

The identical structure exists for track extension 64. As shown in FIG. 2, extension 64 has a rear end region 78 journaled around fastener 56 for turning movement about another vertical turning axis which is parallel to that of track extension 62. Extension 64 is bent at a front end region thereof to form a right-angled upright leg 80 which, in turn, is bent in a plane parallel to extension 64 to form another leg 82. Leg 82 has a rear end region 86 journaled around fastener 56 for turning movement about its turning axis. Another leaf spring 88 and a ball 90, both of which are identical in structure and function to spring 74 and ball 76, are mounted on rear end region 86 for joint turning movement therewith.

Each track extension 62, 64 is independently pivotable between an extended position and a locked position. As illustrated in FIG. 2, extension 62 has been moved to the extended position and, by contrast, extension 64 has been moved to the locked position. In the extended position, as best seen in FIG. 3, track extension 62 is linearly aligned with the stationary support rail 38 and, in fact, forms a continuation thereof along which garment hangers 92 are suspendably and slidably supported. In the locked position, as shown in FIGS. 2 and 5, track extension 64 is situated at a right angle to the rail 40 and prevents any garment hangers on the latter from sliding off.

Garment hangers 92 of the so-called "track type" are of particular utility with respect to the holding arrangement 26 of FIGS. 1–6. As best shown in FIG. 2, each hanger 92 has a metal stem 94 having two side portions 96, 98, a base portion 100, and two inturned flange portions 102, 104, all of which bound a rectangular channel 106. The flange portions 102, 104 bound therebetween a gap 108 in open communication with channel 106. This track-type hanger 92 is entirely conventional in the art and requires no further elaboration.

In order to load garment hangers onto holding arrangement 26, each track extension is moved into the extended position. As best shown in FIG. 2, front leg 68 of extension 62 has a narrow web 109 which is received with clearance through gap 108. Two rectangular cutouts 111, 113 are formed in the front leg 68 on either side of web 109. The cutouts 111, 113 receive with clearance the flange portions 102 104. The extension 62 is freely received in the channel 106. Hence, the front leg 68 is configured to be of complementary contour to the stem of the hanger 92 so that the same can be insertably mounted on the extension 62. Each hanger 92 can be slid lengthwise to any position along the aligned extension and rail. The front leg 80 of the other track extension 64 is similarly configured to be of complementary contour to the stem of the hanger 92 so that the same can be mounted thereon. It should be noted that each standoff 46 or 54 has a transverse width smaller than the gap 108 so that each hanger can be moved past the standoff without mechanical interference.

Hence, in the extended position, a user is provided with a longer support, i.e. the rail and the aligned track extension, from which to suspend hangers, as compared to the conventional situation where no such extensions are provided. The clothing and their hangers can be spread further apart than is conventional in the art, which is of particular utility in the case where the user does not wish to unload all of his or her garments from the bag all at one time, but, instead, as shown in FIG. 1, wishes to leave at least some of the garments in the bag while the same is hung by means of hook member 13 from some convenient support.

In one variant construction, the depth of the bag, as measured from the zippered-up front panels 12, 14 to the rear panel 16, is on the order of the length of a respective rail. Hence, in the extended position, the track extension actually sticks out and projects beyond the plane of the zippered-up front panels. In the locked position, which is the intended position during transit, the extension is located behind the plane of the zippered-up front panels.

In another variant construction, the bag could be pleated and extendable to have an increased depth. In that construction, it would be desirable if the increased depth matched the length of the rail and the extension in the extended position. In that case, the garment bag would have great versatility since garment hangers could be hung on each support rail alone, or, if the bag is extended, on both the support rails and the aligned extensions, thereby greatly increasing the capacity of the bag.

Once a user manually urges a respective extension to the locked position, any garment hanger already mounted on the associated rail is locked thereon and cannot be unloaded without first moving the extension back to the extended position. As best shown in FIG. 2, the extension 64 is in the locked position and lies across the channel 106 of the hanger 92, thereby blocking the side and flange portions 96, 98, 102 and 104 of the stem 94 of the hanger 92 from moving past the extension 64. Even during rough handling, the locked extension does not move from its blocking position, thereby preventing hangers from working themselves free.

In order to ensure that each track extension is not moved past either its extended or locked position, stationary abutments 110, 116 are employed. Abutment 110 is advantageously stamped out as a rectangular tongue from the top plate 28. As best shown in FIG. 4, abutment 110 has one side edge 112 which abuts and stops the leg 70 in the extended position, an another side edge 114 which abuts and stops the leg 70 in the locked position. Similarly, stationary abutment 116 has one side edge 118 which abuts and stops the leg 82 in the locked position, and another side edge 20 which abuts and stops the leg 82 in the extended position.

In order to ensure that each track extension is reliably snappingly engaged and locked in, and does not inadvertently move out of either its extended or locked positions, the aforementioned snap-action elements, consisting of leaf springs 74, 88 and balls 76, 90, are employed. Spring 74 and ball 76 are mounted at rear end region 72 for joint pivoting movement therewith and, similarly, spring 88 and ball 90 are mounted on rear end region 8 for joint pivoting movement therewith. Seating holes 122, 124 are located at opposite ends of curved grooved guide path 126 along which ball 76 is guided. When ball 76 overlies either hole 122 or 124, spring 74 resiliently presses the ball 76 to seat in the respective hole. To move the ball out of its seated hole, it is necessary for the user to supply sufficient force to overcome the pressing force of spring 74. The same situation is true for ball 90 which is guided along curved grooved guide path 128, at opposite ends of which seating holes 130, 132 are situated for snappingly seating the ball 90 in both the extended and locked positions.

In order to prevent interference between the pivotable track extensions, they are pivoted in opposite circumferential directions. Thus, in FIG. 1, extension 62 is turned clockwise, as viewed from above, toward the side panel 20 during movement to the locked position, and extension 64 is turned counterclockwise, as viewed from above, toward side panel 18 when moved to the locked position.

Turning now to the holding arrangement shown in FIGS. 7–14, a garment bag 210 has front panels 212, 214, rear panel 216, side panels 218, 220, top panel 222 and bottom panel 224. One or more zippers are provided between the front panels and the top and bottom panels. For the sake of showing that the invention is not restricted to the specific garment bag illustrated in FIG. 1, a different escutcheon plate 223 is mounted on the top panel. For the same reason, a different link chain 211 and a different hook member 213 are shown mounted to plate 223.

Figure 8:
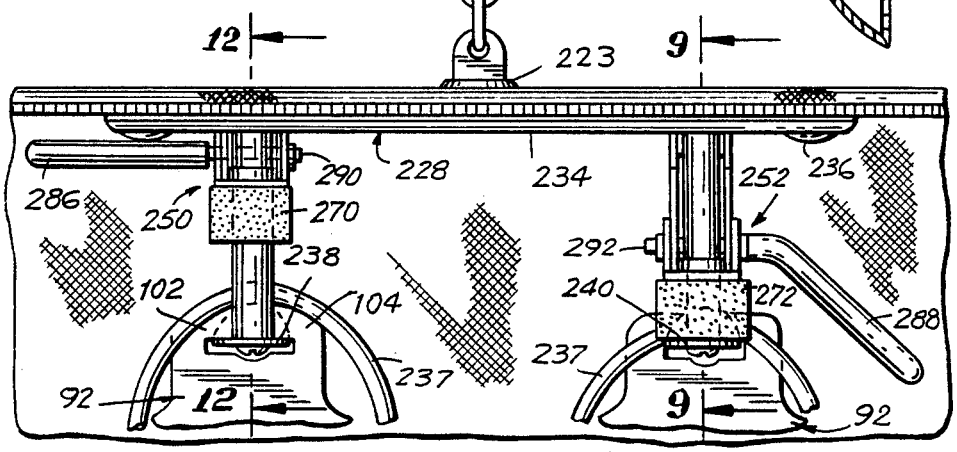
FIG. 8 is a broken-away, partly sectioned, enlarged, front view of the holding arrangement of FIG. 7, with one clamp shown in non-clamped position, and with another clamp shown in clamped position.

As best shown in FIG. 8, the holding arrangement includes a top plate 228 stationarily mounted to the interior top panel 222 of the bag. The top plate has a generally planar major outer surface 234 which is spaced downwardly at a slight spacing from the underside of the top panel 222 due to the presence of border walls 236 extending generally perpendicular to, and perimetrally around, the major surface 234.

A pair of stationary elongated support rails 238, 240 are stationarily mounted to and below top plate 228 in mutual parallelism therewith. Garment hangers of various types, including the aforementioned track type hanger 92, as well as the more conventional wire hangers 235 having curved wire hooks 237, are suspended from, and slidable along, each support rail. A first pair of vertically upright cylindrical guide posts 242, 244 (see FIG. 9) are mounted at opposite ends of rail 240. A second pair of vertically upright cylindrical guide posts 246, 248 (see FIG. 12) are mounted at opposite ends of rail 238. Lower ends of posts 242, 244 are secured to rail 240, while upper ends of posts 242, 244 are secured to top plate 228. Analogously, lower ends of posts 246, 248 are secured to rail 238, while upper ends of these posts are secured to top plate 228. The rails 238, 240 lie in a common plane generally parallel to that of major surface 234, except for bent upright ends 239, 241 which serve as backstops for rails 238, 240. Hangers cannot be moved past these backstops.

According to the embodiment of FIGS. 7–14, the garment hangers 92, 235 are locked onto support rails 238, 240 by means of movable clamps 250, 252 mounted on and below the top plate 228 for rectilinear movement away from and toward the stationary rails 238, 240, respectively, in an up-and-down direction generally perpendicular to the elongations of the rails. The clamps 250, 252 move substantially in a linear path along the elongations of the guide posts. Each clamp 250, 252 is moved between a non-clamped or raised position (see FIGS. 12 and 13 for representative clamp 250) in which the clamp 250 is raised above the rail 238, and a clamped or lowered position (see FIGS. 9 and 10 for representative clamp 252) in which the clamp 252 is pressed against rail 240 and clampingly engages any portions of the hangers lying above the rail 240. Such portions include the aforementioned in-turned flange portions 102, 104 of hangers 92, as well as the wire hooks 237 of wire hangers 235. By way of non-limiting illustration, clamps 250, 252 are shown in FIG. 8 in the non-clamped and clamped positions, respectively. It will, of course, be understood that either or both clamps could be in either or both positions.

Clamps 250, 252 have substantially rigid backing members 254, 256. As best shown in FIGS. 10 and 13, each backing member is of generally flattened U-shaped cross-section, is made of metal, and has planar base walls 258, 260, and upstanding side walls 262, 264 and 266,268, respectively. Blocks 270, 272 of resilient compressible material, e.g. rubber or foam, have a parallelepiped shape, and are secured, for example, by adhesives, to the outer side of base walls 258, 260, respectively. Resilient blocks 270, 272 jointly participate in the up-and-down movement of the backing members. Both the base walls 258, 260 of the backing members and the resilient blocks 270, 272 adhered thereto have mutually aligned guide holes through which the guide posts 246, 248 and 242, 244 extend with slight clearance to ensure rectilinear movement.

A pair of elongated and stretchable coil springs 274, 276, shown in relaxed state in FIG. 12, have lower ends anchored to opposite end regions of the base wall 258, and have upper ends anchored to the top plate 228. Another pair of coil springs 278, 280, shown stretched in FIG. 9, also have lower ends anchored to opposite end regions of the base wall 260 and have upper ends anchored to the top plate 228. Each pair of springs constantly seek to return to their relaxed states and, therefore, act to constantly urge the backing members upwardly toward the top plate 228. Indeed, as shown in FIG. 13, the raised non-clamped position is defined by abutment of upper edges 282, 284 of the backing member 254 against major surface 234 of plate 228. The springs 274, 276 resiliently maintain the abutting relationship between backing member 254 and top plate 228.

In order to lower each clamp from its raised position, turnable L-shaped handles 286, 288 are provided with elongated drive arms 290, 292. As shown in FIG. 11, the drive arms are of non-circular, e.g. square, cross section. The drive arms 290, 292 extend linearly through side walls 262, 264 and 266, 268. Upon turning the handles 286, 288, the drive arms are also turned about drive axes extending lengthwise along the drive arms. A pair of channel-shaped levers 294, 296 have lever arms 298, 300 and 302, 304, respectively. The drive arms 290, 292 extend through, and are mounted in force-transmitting relationship with, lower ends of the lever arms 298, 300 and 302, 304, respectively. Rollers 306, 308 are journaled for rotation about wheel axes on upper ends of the lever arms 298, 300 and 302, 304, respectively. Roller 306 has a central cylindrical wheel portion 306*a* and two side stub shaft portions 306*b*, 306*c*. Roller 308 has a central cylindrical wheel portion 308*a* and two side stub shaft portions 308*b*, 308*c*. Linear slots 310, 312 are formed in top plate 228. Central wheel portions 306*a*, 308*a* extend slightly in, and are rollable along, slots 310, 312. Stub shaft portions 306*b*, 306*c* are rollable along marginal wall portions of the top plate 228 which bound slot 310. Stub shaft portions 308*b*, 308*c* are rollable along marginal wall portions of the top plate 228 which bound slot 312.

The movement of the clamps from their non-clamped to clamped positions will now be described for representative clamp 250.

First of all, in the non-clamped position of FIG. 12, the lever 294 lies lengthwise in an approximately horizontal orientation along the backing member 254 between its side walls 262, 264. The stub shaft portions 306*b*, 306*c* bear against the marginal wall portions of plate 228 bounding slot 310. Thereupon, by turning handle 286 and drive arm 290 in one circumferential direction, the drive arm 290 also turns the lever 294 about the drive axis of arm 290. Since the stub shaft portions 306*b*, 306*c* bear against the top plate, and since these stub shaft portions are connected to the upper ends of lever 294, the only movement permitted for the lever is a downward movement in which the lower ends of the lever 294 descend and move away from the top plate 228. Upon continued turning of the drive arm 290, the lever 294 continues to turn; the stub shaft portions 306*b*, 306*c* continue to rolls along the marginal wall portions bounding slot 310; the central wheel 306*a* continues to roll inside slot 310; the lower ends of the lever 294 continue to descend and the lever 294 itself moves away from its initial generally horizontal orientation to a more upright orientation. Eventually, the point is reached where the lever 294 extends in a vertical direction approximately perpendicular to the top plate 228, i.e. where the upper and lower ends of lever 294 are in a vertical line. At about this point, the stub shaft portions 306*b*, 306*c* are caused to ride over bumps 314 which are formed as stamped-out tongues and depend from the top plate. The force exerted by the user in turning handle 286 is transmitted through the lever 294 and the roller 306, and is more than sufficient to cause the stub shaft portions 306*b*, 306*c* to ride over bumps 314. After passing by the bumps, the upper ends of lever 294 are situated slightly rearwardly of the lower ends of lever 294. Put another way, the aforementioned wheel axis about which the roller 306 turns is located rearwardly of the aforementioned drive axis of the drive arm. A pair of depending tongues or flanges 316, 318 (see FIG. 14) are stamped out of, and depend downwardly from, top plate 228. These flanges are located in the path of movement of the lever arms 298, 300 and serve as stops past which the lever 294 cannot move. The flanges 316, 318 may abut either against the lever arms 298, 300 or the stub shaft portions 306*b*, 306*c* of the roller. The roller is, in effect, captured between the bumps 314 at one side of the roller and the flanges 316, 318 at the other side of the roller in an "over-the center" locking position and, therefore, cannot move.

During the descent of the lower end regions of the lever 294, the backing member 254 and the resilient block 270 likewise descend. At the same time, the springs 274, 276 are stretched. In the lowered position, assuming, for the moment, that no hangers are supported on rail 238, the bottom of the block 270 is in surface engagement with the rail 238 along the entire length thereof with only a slight compression, if any, of the block 270. If wire hooks 237 and/or in-turned flange portions 102, 104 were present above the rail 238, then, as shown in FIG. 9, the block 270 would compress to the requisite extent and clampingly confine such elevated portions of the rail.

In order to return the clamp to the non-clamped position, one merely turns the handle and its drive arm in the opposite circumferential direction until the stub shaft portions ride in opposite direction back over the bumps 314. Once having cleared the bumps, the springs take over and suddenly pull the backing member 254 and the block 270 upwardly until upper edges of the backing member 254 engage the top plate. The relaxed springs 274, 276 are under a slight tension so as to maintain the clamp 250 in the raised position.

The analogous situation is equally valid for clamp 252 and will not be repeated for the sake of brevity.

Hence, in accordance with both of the aforementioned embodiments, garment hangers are reliably and securely supported on stationary support rails. The garment hangers may be locked in position by either moving a track extension to a position transverse of the rail, or by clamping the hangers onto the rail. The hangers cannot work themselves free from their confinement, thereby reliably protecting clothes hung on the hangers from wrinkling or crushing during transit.

Although the above embodiments have been described solely in connection with their application for holding garments in garment bags, it will be expressly understood that the invention is not intended to be s limited, since the holding arrangements can be utilized to hold objects other than hangers, e.g. files, and can be mounted in other enclosures such as moving containers for transporting virtually any object.

In addition, the second embodiment is not intended to be limited to pure rectilinear movement of the clamps 250, 252 up and down the guide posts 242, 244, 246, 248. Indeed, in the preferred construction, each clamp "walks" up a respective pair of posts. Thus, as shown in FIG. 9 for representative clamp 252, the left end of clamp 252 is initially raised above the right end. Then the right end of clamp 252 is raised above the already raised left end. This step-wise alternate elevation of the left and right ends of clamp 252 continues until the latter is in its raised position (see FIG. 12). During the ascent, and analogously during the descent, of each clamp, the springs act as a counterbalance.

Finally, the aforementioned conventional track-type hanger 92 need not have its hook deployed when used in the arrangements of this invention. Each track-type hanger is conventionally provided with a hook pivotably mounted on the stem 94. Whereas, in the prior art, this hook had to be swung above the stem in order to lock the hanger inside a garment bag, this invention does not require the hook to be deployed whatsoever, since locking can occur without such deployment.

It will be understood that each of the elements described above, or two or more together, also may find useful application in other types of constructions differing from the types described above.

While the invention has been illustrated and described as embodied in an arrangement for securely holding garment hangers within garment bags, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention and, therefore, such adaptations should and are intended to be comprehended within the meaning and range of equivalence of the following claims.

What is claimed as new and desired to be protected by Letter Patent is set forth in the appended claims.

I claim:

1. An arrangement for holding garment hangers within a travel garment bag having an interior top wall, said arrangement comprising:

(a) a top plate stationarily mounted to the interior top wall of the garment bag;

(b) an elongated supported rail having front and rear end regions and longitudinal side edge regions extending lengthwise along the rail;

(c) means for stationarily mounting the rail to and below the top plate, including upright front and rear posts respectively fixed at the front and rear end regions of the rail, said front post being centrally mounted between the side edge regions of the rail;

(d) a garment hanger having a stem with side, base, and flange portions bounding an interior channel in which the rail is slidingly received for suspendably and slidably supporting the hanger from the rail, said flange portions slidably contacting the side edge regions of the rail and extending transversely toward, but terminating short of, each other to form therebetween a clearance passage through which the front post passes with clearance, while maintaining sliding contact between the flange portions and the side edge regions of the rail, upon sliding the hanger past the front post; and (e) means for locking the garment hanger on the rail to prevent demounting of the hanger during handling of the garment bag in transit, said locking means including a pivotable elongated track extension mounted to and below the top plate for pivoting movement relative to the stationary rail along a path between an extended position in which the track extension is aligned with the stationary rail and forms a continuation thereof along which garment hangers are suspendably and slidably supported, and a locked position in which the track extension is transverse to the stationary rail and prevents garment hangers from sliding off the stationary rail.

2. The arrangement as recited in claim 1, wherein the locking means includes a stationary abutment on the top plate and situated in the path of pivoting movement of the track extension, for abutting against and fixing the track extension in both the extended position and the locked position.

3. The arrangement as recited in claim 2, wherein the locking means includes snap-action elements on the top plate and the track extension for snappingly securing the track extension in both the extended and the locked positions.

4. The arrangement as recited in claim 3, wherein the snap-action elements include a projection and biasing means for urging the projection into resilient engagement with the top plate, said projection and biasing means being mounted on the track extension, and a pair of detents in the top plate and spaced apart along the path of pivoting movement of the track extension, each detent receiving the projection with snap action in a respective one of the extended and locked positions.

5. The arrangement as recited in claim 1, wherein the extension has side edge regions extending lengthwise along the extension, and an outer front end region of complementary contour to that of the channel to enable the hanger to be moved past the outer front end region of the extension and removed from the extension while maintaining sliding contact between the flange portions and the side edge regions of the extension.

6. An arrangement for holding garment hangers within a travel garment bag having an interior top wall, said arrangement comprising:

(a) a top plate stationarily mounted to the interior top wall of the garment bag;

(b) an elongated support rail having front and rear end regions and longitudinal side edge regions extending lengthwise along the rail;

(c) means for stationarily mounting the rail to and below the top plate, including upright front and rear posts respectively fixed at the front and rear end regions of the rail, said front post being centrally mounted between the side edge regions of the rail;

(d) a garment hanger having a stem with side, base, and flange portions bounding an interior channel in which the rail is slidingly received for suspendably and slidably supporting the hanger from the rail, said flange portions slidably contacting the side edge regions of the rail and extending transversely toward, but terminating short of, each other to form therebetween a clearance passage through which the front post passes with clearance, while maintaining sliding contact between the flange portions and the side edge regions of the rail, upon sliding the hanger past the front post; and (e) means for locking the garment hanger on the rail to prevent demounting of the hanger during handling of the garment bag in transit, said locking means including a movable clamp mounted on and below the top plate for rectilinear movement away from and toward the stationary rail in a rectilinear direction generally perpendicular to the elongation of the stationary rail along a path between a non-clamped position in which the clamp is raised above the stationary rail, and a clamped position in which the clamp clampingly engages garment hangers supported on the stationary rail.

7. The arrangement as recited in claim 6, wherein the movable clamp includes a substantially rigid backing member having a pair of guide holes, and a resilient material block secured to the backing member and facing the stationary rail; said posts extending along said rectilinear direction and through the guide holes for rectilinearly guiding the resilient block.

8. The arrangement as recited in claim 7, wherein the locking means includes biasing means for constantly urging the movable clamp to the non-clamped position.

9. The arrangement as recited in claim 8, said biasing means including a pair of elongated coil springs having opposite ends connected to the top plate and the backing member, each spring being stretched to a high-tensioned state in the clamped position, and being relaxed to a less-tensioned state in the non-clamped position.

10. The arrangement as recited in claim 9, wherein the locking means includes a manually turnable handle, and means for moving the movable clamp between the non-clamped and clamped positions upon turning of the handle.

11. The arrangement as recited in claim 6; and further comprising two support rails and two locking means, all mounted on the top plate.

12. The arrangement as recited in claim 6, for use with garment hangers having a wire hook hooked over the support rail; and wherein the clamp includes a resilient material block compressible to clampingly engage both the wire hook and the flange portions of different hangers against the rail.

13. An arrangement for holding garment hangers within a travel garment bag having an interior top wall, said arrangement comprising:

(a) a top plate stationarily mounted to the interior top wall of the garment bag;

(b) a stationary elongated supported rail for suspendably and slidably supporting garment hangers therefrom and being stationarily mounted to and below the top plate; and (c) means for locking the garment hangers on the stationary rail to prevent demounting of the garment hangers during handling of the garment bag in transit, said locking means including (i) a pivotable elongated track extension mounted to and below the top plate for pivoting movement relative to the stationary rail along a path between an extended position in which the track extension is aligned with the stationary rail and forms a continuation thereof along which garment hangers are suspendably and slidably supported, and a locked position in which the track extension is transverse to the stationary rail and prevents garment hangers from sliding off the stationary rail, and (ii) a stationary abutment on the top plate and situated in the path of pivoting movement of the track extension, for abutting against and fixing the track extension in both the extended position and the locked position, said stationary abutment being a tongue offset from the top plate, and having one side edge abutting the track extension in the extended position and another side edge abutting the track extension in the locked position.

14. An arrangement for holding garment hangers within a travel garment bag having an interior top wall, said arrangement comprising:

(a) a top plate stationarily mounted to the interior top wall of the garment bag;

(b) a stationary elongated support rail for suspendably and slidably supporting garment hangers therefrom and being stationarily mounted to and below the top plate; and (c) means for locking the garment hangers on the stationary rail to prevent demounting of the garment hangers during handling of the bag in transit, said locking means including (i) a movable clamp mounted on and below the top plate for rectilinear movement away from and toward the stationary rail in a rectilinear direction generally perpendicular to the elongation of the stationary rail along a path between a non-clamped position in which the clamp is raised above the stationary rail, and a clamped position in which the clamp clampingly engages garment hangers supported on the stationary rail, said movable clamp including (A) a substantially rigid backing member having a pair of guide holes, and (B) a resilient material block secured to the backing member and facing the stationary rail, (ii) a pair of elongated guide posts extending along said rectilinear direction and through the guide holes for rectilinearly guiding the resilient block, (iii) biasing means for constantly urging the movable clamp to the non-clamped position, said biasing means including a pair of elongated coil springs having opposite ends connected to the top plate and the backing member, each spring being stretched to a high-tensioned state in the clamped position, and being relaxed to a less-tensioned state in the non-clamped position, (iv) a manually turnable handle, and (v) means for moving the movable clamp between the non-clamped and clamped positions upon turning of the handle, said moving means including (A) an elongated lever having a driven end pivotably mounted on the backing member for joint turning with the handle, and (B) an opposite drive end on which a roller is journaled, said roller being urged into rolling engagement by the biasing means.

15. The arrangement as recited in claim 14, wherein the top plate has an elongated slot, and wherein the roller has a central wheel portion received in and rollable along the slot, and a pair of side stub shaft portions in rolling engagement with wall portions of the top plate bounding the slot.

16. The arrangement as recited in claim 15, wherein the locking means includes stationary abutments on the top plate and situated in the path of rectilinear movement of the clamp, for abutting against and fixing the clamp in both the non-clamped and clamped positions.

17. The arrangement as recited in claim 16, wherein the abutments are arranged in pairs, one pair for each side stub shaft portion, each abutment pair including a tongue and a ride-over bump situated on opposite sides of a respective stub shaft portion for locking the clamp in the clamped position.

* * * * *